United States Patent [19]

Gragson

[11] 4,200,602

[45] Apr. 29, 1980

[54] METHOD FOR PRODUCING FILAMENTS OF HIGH TENACITY

[75] Inventor: James T. Gragson, Bartlesville, Okla.

[73] Assignee: Phillips Petroleum Company, Bartlesville, Okla.

[21] Appl. No.: 752,933

[22] Filed: Dec. 22, 1976

[51] Int. Cl.[2] ..... B05B 3/00; B29F 3/08

[52] U.S. Cl. ..... 264/28; 264/237; 528/332; 528/480; 528/481; 264/210.8; 264/290.5

[58] Field of Search ..... 264/28, 176 F, 210 F, 264/290 N, 290 R, 290 T; 528/332, 480, 481

[56] References Cited

U.S. PATENT DOCUMENTS

| | | | |
|---|---|---|---|
| 2,846,289 | 8/1958 | Gray | 264/28 |
| 3,027,602 | 4/1962 | Hamilton et al. | 264/178 R |
| 3,054,652 | 9/1962 | Heumann | 264/28 |
| 3,544,670 | 12/1970 | Murao et al. | 264/237 |
| 3,946,094 | 3/1976 | Kanetsuna et al. | 264/28 |

FOREIGN PATENT DOCUMENTS

| | | | |
|---|---|---|---|
| 1435603 | 1/1969 | Fed. Rep. of Germany | 264/28 |
| 1095750 | 12/1967 | United Kingdom | 264/28 |

*Primary Examiner*—Jay H. Woo

[57] ABSTRACT

A molten polymer is extruded through at least one orifice to produce a filament which is immediately cooled to a temperature below its glass transition temperature by contacting the filament with a gas having a temperature ranging from about +10° C. to about −20° C.

4 Claims, No Drawings

METHOD FOR PRODUCING FILAMENTS OF HIGH TENACITY

The invention relates to a filament and to a method for producing a filament from thermoplastic polymers. In another aspect, the invention relates to gas quenching thermoplastic filaments produced by melt spinning.

The process of melt spinning thermoplastic synthetic filaments by extruding a molten polymer through a spinneret having at least one orifice to produce a filament, cooling the filament to a temperature below the glass transition temperature of the polymer and heating and drawing the filament to substantially improve the physical properties of the filament such as tenacity, modulus, elongation, etc. is well known in the art. Further, it is recognized in the art, such as for example U.S. Pat. No. 3,489,832 issued to Bruton et al on Jan. 13, 1970, that the temperature of the medium employed to cool the freshly spun filament to a temperature below the glass transition temperature of the polymer is important. Burton et al broadly teach that in spinning polycaproamide yarns the temperature of the quenching air should not be above 35° C. and in a specific example employ quench air at a temperature of 28° C.

In two other patents, U.S. Pat. No. 3,118,012 and U.S. Pat. No. 3,213,171 issued to J. J. Kilian on Jan. 4, 1964 and on Oct. 19, 1965 respectively, quenching freshly spun filaments with a gas having a temperature ranging from 15° C. to 40° C. is described. In addition, the patent teaches that the use of the cooler medium simply adds undue cost to the process.

Dutch Pat. No. 7,307,431 describes a process for producing fibers from crystalline plastic materials which have extraordinarily good properties. The patent describes a process employing a liquid quenching medium as compared to the gaseous quenching medium used in the previously discussed patents. The liquid quenching medium is maintained at very low temperatures. For example, the patent teaches that the cooling bath must be kept at a temperature of less than −30° C., and preferably less than −50° C. Several examples are described in the patent in which the temperature of the quenching liquid ranged from −75° C. to −100° C. Although it is well known in the art that generally the use of a liquid quenching bath alters the properties of the filaments and particularly the surface of the fiber as compared to a gas quenching medium, the Dutch patent does teach that the properties of filaments quenched with a liquid bath can be improved by lowering the temperature of the bath; however, extremely low temperatures are required.

It was found that the properties of filaments quenched or cooled with a gas, such as air, nitrogen, carbon dioxide or other gas inert to the process, can be substantially improved if the temperature of the gas is somewhat colder than that taught by Burton et al or Kilian. Such a result is surprising in view of the prior art discussed above, and particularly in view of the teaching of Kilian that temperatures of the quenching gas below about 15° C. simply added undue cost to the process and in view of the fact that a substantial improvement in the properties of the fibers can be realized without employing quenching liquid baths operated at temperatures of −30° C. and lower.

It is an object of the invention to produce gas quenched thermoplastic filaments having improved properties as compared to filaments produced in accordance with the prior art.

Another object of the invention is to improve the properties of gas quenched thermoplastic filaments and at the same time minimize the expense in producing the filaments.

SUMMARY OF THE INVENTION

According to the invention, a molten polymer is extruded through at least one orifice to produce a filament and the filament is immediately cooled to a temperature below its glass transition temperature by contacting the filament with a gas having a temperature ranging from about −20° C. to about 10° C., wherein the polymer is selected from the group consisting of polyethylene terephthalate, polycaprolactam, and the condensation product of 5-methyl-1,9-nonanediamine and terephthalic acid.

The present invention is applicable to a specific group of thermoplastic polymers. The polymers suitable for use in the invention are polyethylene terephthalate, polycaprolactam and poly(5-methyl-1,9-nonamethylene terephthalamide) which is the condensation product of 5-methyl-1,9-nonanediamine and terephthalic acid.

Further, the invention is limited to the use of gas quenching processes as compared to liquid quenching processes. The gases that can be employed according to the invention vary widely, the only requirement being that the gas is inert with respect to the polymer being extruded. Some of the gases suitable for use in the invention include for example air, nitrogen, helium, and carbon dioxide; however, air was used in the Example hereinafter described with good success and because it is readily available, air is the preferred gas quenching medium.

According to the invention the temperature of the gas quenching medium broadly is within the range of from about −20° C. to about 10° C.; however, good results were obtained employing a gas temperature ranging from about −10° C. to about 0° C. Although it may be possible to obtain filaments with improved properties when employing quenching gas temperatures below −20° C., one object of the invention is to minimize the cost of the process while obtaining an improvement in the properties of the filaments as compared to filaments obtained employing prior art processes. Based upon the good results obtained employing a gas temperature ranging from about −10° C. to about 0° C., it is believed that the lowest temperature that should be employed from an economic standpoint is −20° C.

Most any spinning apparatus used for melt spinning thermoplastic filaments known in the art can be used in the present invention provided it is capable of providing quenching gas within the temperature ranges defined above. Also the filament or filaments produced in accordance with the invention are drawn employing apparatus known in the art. No special equipment is required to draw the filaments produced in accordance with the present invention.

Generally the filaments produced by the process of the invention are drawn employing heater temperatures ranging from about 2° C. to about 40° C. below the glass transition temperature of the polymer. Based upon the results of the Example hereinafter described, it is believed that good results can be obtained employing heater temperatures ranging from about 5° C. to about 20° C. below the glass transition temperature of the polymer.

EXAMPLE

Four runs were carried out to demonstrate the invention. Runs 1 and 3 were carried out in accordance with the invention and runs 2 and 4 were carried out outside the scope of the invention. In all the runs the polymer employed was the condensation product of 5-methyl-1,9-nonanediamine and terephthalic acid. The polymer was extruded using a piston extruder having approximately a 20 gram capacity and using a 6 hole spinneret with 0.009 inch (0.023 cm) diameter holes and with a capillary length of 0.012 inches (0.030 cm). The extrusion rate was 1 cc/min and the spinning temperature was 300° C. Two take up speeds were employed, 280 feet/min (85.34 meters/min) in runs 1 and 2 and 400 feet/min (121.92 meters/min) in runs 3 and 4. The filaments were drawn employing two godet rolls with a heat positioned between the rolls and operated at 100° C. The glass transition temperature of the polymer employed in the runs was 112° C. In runs 2 and 4, the non-inventive runs, ambient air was used as the quenching air which had a temperature ranging from about 20° C. to 25° C. In the invention runs, runs 1 and 3, the freshly spun filaments were passed through an insulated double wall cylindrical chamber having an inside diameter of 4 inches (10.16 cm) and an outside diameter of 6 inches (15.24 cm) to provide an annular space of approximately 1 inch (2.54 cm). The cylindrical chamber was positioned immediately below the spinneret and had a length of 2 feet (0.609 meters). In the runs carried out in accordance with the invention, runs 1 and 3, the annulus was filled with dry ice so that the air inside the cylindrical chamber was maintained with in the range of −10° C. to 0° C. The results of runs 1 to 4 are provided in Table I below:

TABLE I

| Run # | Temp. of Quench Air | Draw Ratio | Take up Speed (feet/min) | Denier | Tenacity[1] g/denier | Percent[2] Elongation | Modulus (initial) |
|---|---|---|---|---|---|---|---|
| 1 | −10° C. to 0° C. | 4.5 | 280 | 25 | 3.7 | 19.1 | 34 |
| 2 | 20° C. to 25° C. | 4.5 | 280 | 25 | 3.3 | 17.5 | 32 |
| 3 | −10° C. to 0° C. | 4.5 | 400 | 20 | 3.35 | 19.0 | 29.6 |
| 4 | 20° C. to 25° C. | 4.5 | 400 | 21 | 2.81 | 16.5 | 24.6 |

[1]Tenacity was determined employing ASTM test D 2101-72
[2]Percent Elongation was determined employing ASTM test D 2256-72
[3]Modulus was determined employing ASTM test D 885-72

Runs 2 and 4 employing a quench air temperature within the range of temperatures described in Burton et al and Kilian discussed in the background of the invention produced filaments having a lower tenacity, percent elongation, and initial modulus as compared to the filaments produced in Runs 1 and 3 respectively. Of course, the comparison is made only between yarns of approximately the same denier, i.e., run 1 with run 2 and run 3 with run 4.

What is claimed is:

1. A method comprising extruding a molten polymer through at least one orifice to produce a filament and immediately cooling said filament to a temperature below its glass transition temperature by contacting said filament with a gas having a temperature ranging from about −20° C. to about 10° C., said polymer is the condensation product of 5-methyl-1,9-nonanediamine and terephthalic acid wherein the filament is heated and drawn at a temperature ranging from about 2° C. to about 40° C. below the glass transition temperature of the polymer.

2. The method of claim 1 wherein the temperature of the gas ranges from about −10° C. to about 0° C.

3. The method of claim 1 wherein the gas is air.

4. The method of claim 1 wherein the filament is drawn at a temperature ranging from about 5° C. to about 20° C. below the glass transition temperature of the polymer.

* * * * *